US005218889A

United States Patent [19]

Brockberg

[11] Patent Number: 5,218,889

[45] Date of Patent: Jun. 15, 1993

[54] LIGHT BULB HANDLING DEVICE

[76] Inventor: James A. Brockberg, 9104 68th Street N., Stillwater, Minn. 55082

[21] Appl. No.: 813,986

[22] Filed: Dec. 26, 1991

[51] Int. Cl.[5] ..... B25B 21/00

[52] U.S. Cl. ..... 81/53.11; 81/64

[58] Field of Search ..... 81/53.11, 64

[56] References Cited

U.S. PATENT DOCUMENTS

| | | | |
|---|---|---|---|
| D. 297,499 | 9/1988 | Whitney . | |
| 1,024,286 | 4/1912 | Santilli . | |
| 1,311,776 | 7/1919 | Rodriguez . | |
| 1,655,979 | 1/1928 | Watkins | 81/53.11 |
| 1,847,953 | 3/1932 | Finesey . | |
| 2,157,563 | 5/1939 | Pethick . | |
| 2,545,043 | 3/1951 | Odenthal . | |
| 2,573,002 | 10/1951 | Foster . | |
| 2,634,998 | 4/1953 | Flower . | |
| 2,637,587 | 5/1953 | Robinson . | |
| 4,901,606 | 2/1990 | Christensen . | |

OTHER PUBLICATIONS

Instructions for the Mityvac Obstetrical Vacuum Delivery Kit.

*Primary Examiner*—James G. Smith

*Attorney, Agent, or Firm*—Merchant, Gould, Smith, Edell, Welter & Schmidt

[57] ABSTRACT

A light bulb manipulating device (10) which comprises a unitary plastic structure (11) and a vacuum forming means (12) is disclosed. The device (10) incorporates a receptacle (15), a flexible, annular rim (20) and at least one projection (17) for application of a rotational motion about a longitudinal axis (A—A). The device (10) can manipulate a wide variety of light bulbs ranging from small conical or globe-type bulbs to essentially flat, flood or spot lights and is, therefore, versatile, economical, and easily operated.

8 Claims, 4 Drawing Sheets

LIGHT BULB HANDLING DEVICE

FIELD OF THE INVENTION

My invention relates to a remote light bulb handling device for screw-type light bulbs. In particular, the invention relates to a device which is useful for manipulating a wide variety of light bulb sizes and shapes.

BACKGROUND OF THE INVENTION

Modern household design is placing light bulbs in increasingly inaccessible locations. The advent of canister lighting recessed into household ceilings has placed light bulbs into openings which are often out of reach of the average person or the openings themselves are too small to allow adequate room to reach in to manipulate the bulb. In addition, these cans can prevent the average person from obtaining a sufficient grip to remove a stubborn bulb which is stuck in the socket. Finally, a newly burned-out bulb may remain very hot to the touch for some time which could burn an unwary individual's fingers.

These problems have been recognized by numerous inventors over the years who have proposed a number of solutions. For instance, Santilli, U.S. Pat. No. 1,024,286, discloses a tool for handling globe lamps. This tool employs a globe receptacle which is configured to engage the nearly vertical sides of a globe-shaped light bulb. A slight vacuum is formed in the interior of the receptacle causing its sides to grasp the sides of the globe. Because the light bulb is grasped with nearly vertical sides of the globe receptacle, the device must be closely sized to the globe-shaped bulb. Further, the device does not appear to be useful for the handling of flood lights or more conical bulbs. Therefore, the device is of limited usefulness.

Another example of a light bulb handling device is illustrated in Pethick, U.S. Pat. No. 2,157,563. This device employs a bulb receptacle which, when pressed onto a screw-type light bulb having a convex lower end, creates a vacuum. The vacuum provides holding power for the manipulation of the bulb. When the user desires to remove the bulb from the receptacle, one portion of the receptacle may be deformed to break the vacuum in the void between the bulb and receptacle. While this device appears to be somewhat more versatile than previous designs, it still requires the bulb surface to be convex and the receptacle cup must be deformed to break the vacuum and allow the device to be removed from the bulb.

Flower, U.S. Pat. No. 2,634,998, discloses a similar design to that of Pethick. In contrast to the design of Pethick, however, Flower employs an annular circumferential ridge to allow his device to handle light bulbs having a smaller circumferential dimension. In addition, Flower incorporates a cushioning pad at the bottom of his receptacle to reduce bulb breakage. However, this pad also restricts the light bulb configurations which can be manipulated by the device.

Odenthal, U.S. Pat. No. 2,545,043, discloses a light bulb changer which requires a relatively complicated check valve system to provide a vacuum within a bulb receptacle area. This vacuum force holds the bulb in place until downward pressure on the receptacle handle opens the check valve to break the vacuum within the bulb receptacle. Again, the geometry of the receptacle cup severely limits the usefulness of the device with respect to bulb type and size.

Finally, Foster, U.S. Pat. No. 2,573,002, discloses yet another appliance for handling overhead electric lamps. This device utilizes a funnel-shaped bulb receptacle for contacting overhead bulbs affixed to an elongate hollow tube. The tube is connected to a piston-type device for creating a vacuum within a void defined by the receptacle and a bulb. Again, the geometry of the receptacle cup severely limits the usefulness of the device with respect to bulb type and size.

After reviewing the prior art, it remains apparent that a new light bulb handling device is needed which is extremely versatile and can handle screw-type bulbs of a wide variety of shapes and sizes. Further, a device is needed which can effectively increase the leverage of applied torque to remove stubborn bulbs. These and other needs are met by the following invention.

SUMMARY OF THE INVENTION

The invention is a light bulb manipulating device which includes a unitary, plastic structure and a vacuum forming means. The unitary structure is formed into a receptacle, an annular rim, a hollow conduit, and at least one projection for external application of a rotational motion about a longitudinal axis of the device. The construction of the device allows the use of polymeric material which is flexible enough to conform to a variety of light bulb surfaces while remaining stiff enough to be dimensionally stable through the remainder of the structure.

The device may further incorporate an annular friction-enhancing collar which sealingly engages and is removably attached to the annular rim.

DETAILED DESCRIPTION OF THE PREFERRED EMBODIMENT

Figure 1:
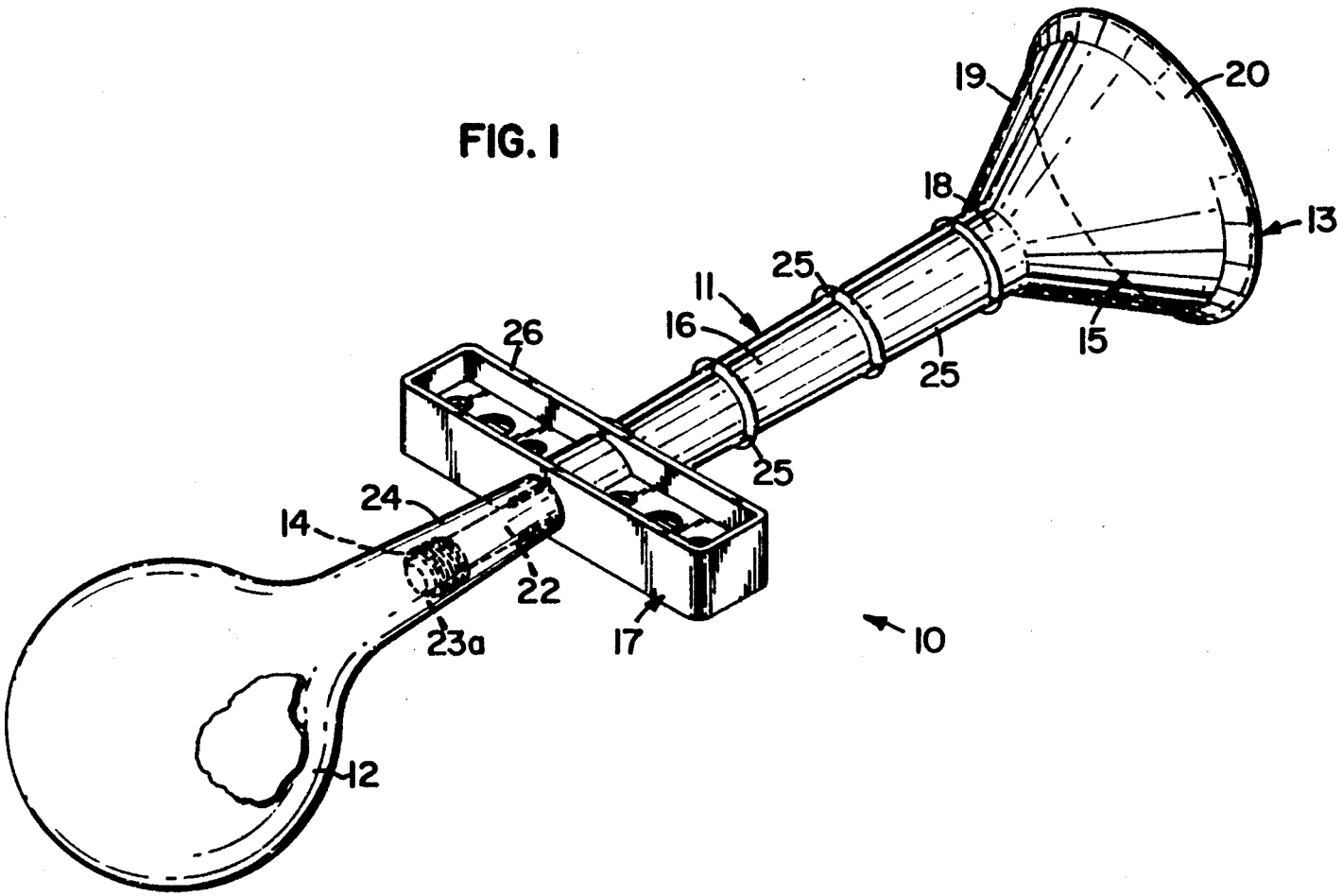
FIG. 1 illustrates a perspective view of a device according to the invention.
Figure 2:
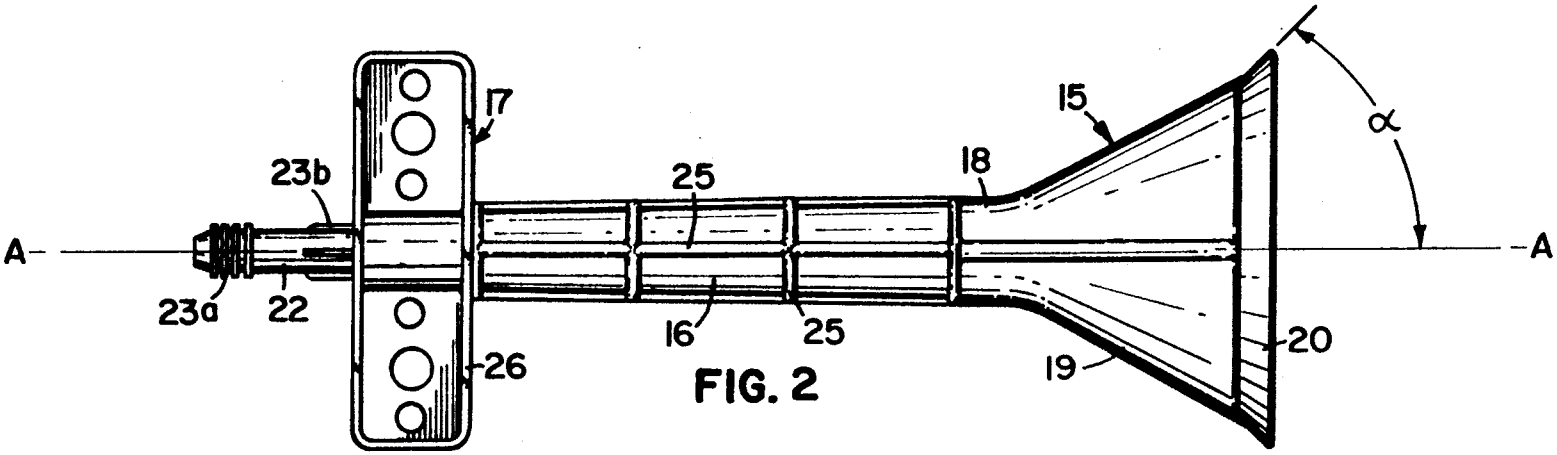
FIG. 2 illustrates a front view of the invention.
Figure 3:
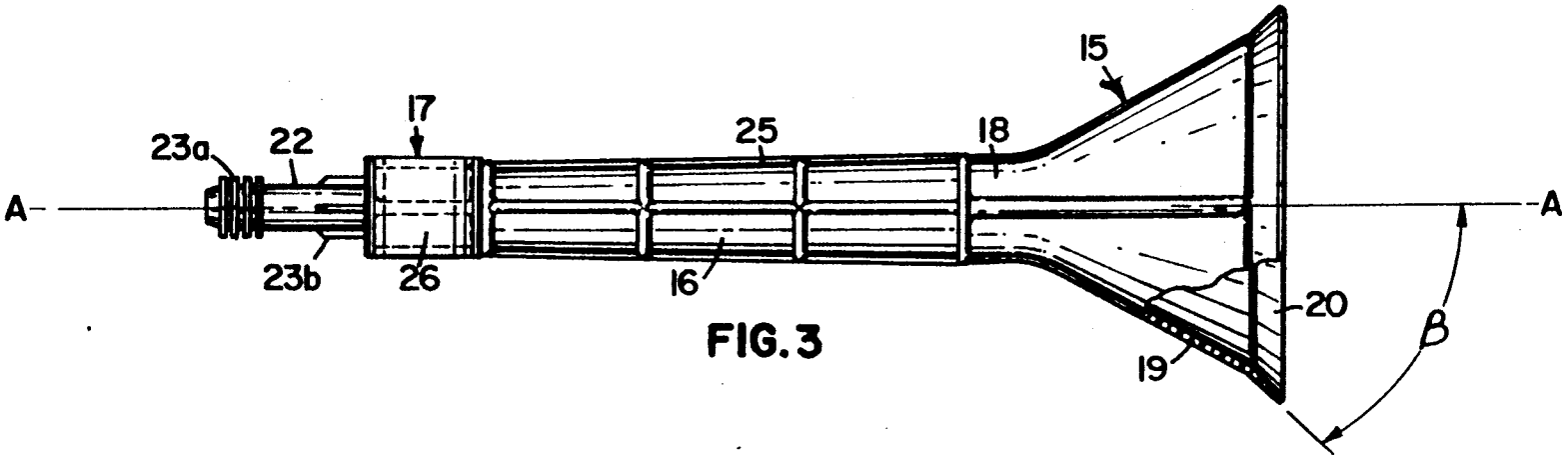
FIG. 3 illustrates a side view of the invention having a portion of the light bulb receiving member broken away.

Referring to FIGS. 1–3, the preferred light bulb handling device 10 has a molded plastic structure 11 and a vacuum bulb 12. The preferred molded plastic structure 11 is formed of a unitary piece of polymeric material. The plastic structure 11 may be formed of any polymeric material which is stiff enough to transmit applied torque to turn a stubborn light bulb while remaining slightly flexible and resilient to provide handling portions which are pleasing to the user's grip and which can slightly flex to conform to a light bulb surface. In addition, the material is preferably easily formed by injection molding, blow molding, etc.

Preferred materials for constructing the plastic structure are generally non-elastomeric, thermoplastic materials. The term "non-elastomeric", as used in the specification and the claims, means materials which do not meet the American Society for Testing and Materials definition of elastomer, "a polymeric material which at room temperature can be stretched to at least twice its original length and upon immediate release of the stress will return quickly to approximately its original length." A representative, non-limiting list of such materials includes polyolefins such as polyethylene and polypropylene, vinyl polymers such as plasticized polyvinyl chloride, and polyamides such as nylon. Particularly preferred materials include the polyolefins, and most preferably, the unitary plastic structure is high density polyethylene.

The plastic structure 11 has a receiving end 13 and a bottom end 14 and is formed to provide a receptacle 15, a hollow conduit 16, and projections 17. The preferred receptacle 15 is a generally frusto-conical shape having a radius from a longitudinal axis A—A which increases from a minimum at the base 18 of the receptacle 15 to a maximum near the receiving end 13. Of course, the receptacle 15 may also have a radius which increases at varying rates from the hollow conduit 16 to the receiving end 13. In other words, the receptacle 15 may be bell-shaped or tulip-shaped.

In the preferred frusto-conical shaped receptacle 15, the receptacle wall 19 and the longitudinal axis A—A form an angle $\alpha$ of about 25° to 40°. More preferably, $\alpha$ is about 30°. If this angle is too narrow, the device 10 is inefficient in handling many of the standard light bulbs, inefficient in handling many of the standard light bulbs, and if this angle is too great, the receptacle 15 cannot easily accommodate more conical bulbs (e.g., those similar in shape to standard Christmas bulbs).

To improve the usefulness of the device 10 in manipulating larger and flatter bulb surface, an annular, flexible rim 20 extends from the receiving end 13 of the receptacle 15. The preferred annular rim 20 has a frusto-conical shape and has a radius from a longitudinal axis A—A which increases from a minimum at the receptacle 15 to a maximum near the receiving end 13. In this preferred frusto-conical configuration, the rim 20 and the longitudinal axis A—A form an angle $\beta$ which is greater than $\alpha$. More preferably, $\beta$ is about 45°. To increase the flexibility of the annular rim 20, its thickness is preferably less than that of the receptacle 15.

Figure 6:
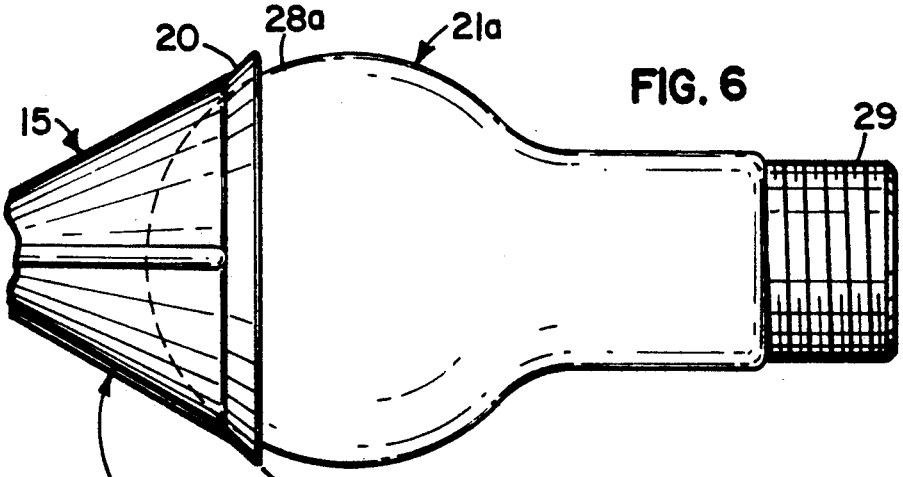
FIG. 6 illustrates the contact between a standard light bulb and the receiving end of the device of the invention during use.
Figure 7:
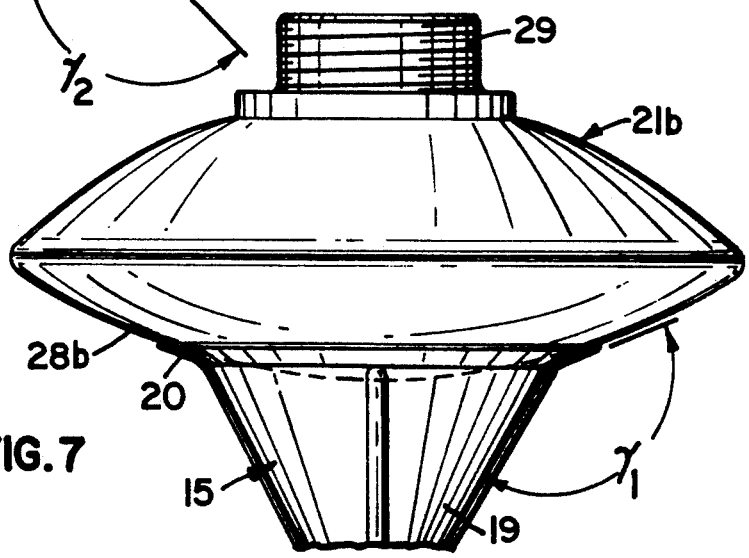
FIG. 7 illustrates the contact between a flood light bulb and the receiving end of the device of the invention during use.
Figure 8:
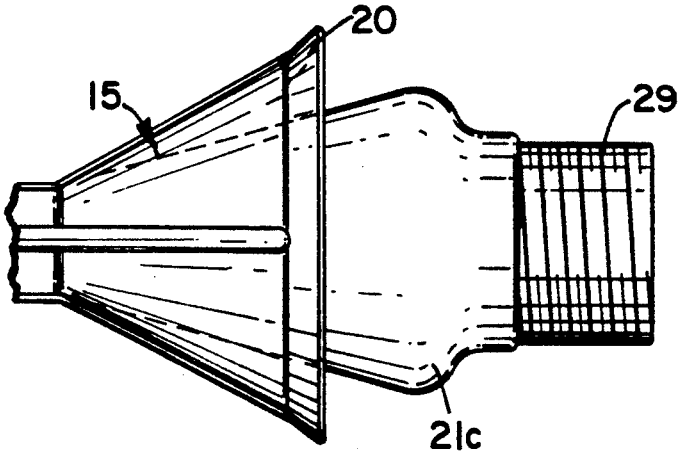
FIG. 8 illustrates the contact between a decorative light bulb and the receiving end of the device of the invention during use.

Referring now to FIGS. 6–8, the annular rim 20 is arranged and configured to allow the device 10 to accommodate a wide variety of screw-type light bulbs (e.g., **21*a*–21*c*). In particular, the annular rim 20 is effective to provide a larger gripping surface for interfacing with larger light bulbs 21*b* such as flood lights or spot lights. When a flood light 21*b* is engaged by the receptacle 15 and rim 20, the bulb surface 28*b* deflects the rim 20 to form an angle $\gamma_1$. When a standard bulb 21*a* is engaged by the receptacle, the bulb surface 28*a* does not engage the rim 20, and therefore angle $\gamma_2$ is larger than $\gamma_1$ formed with a flood light 21*b*. When the device 10 is to be used with smaller light bulbs 21*a* or 21*c*, the annular rim 20 does not interfere with the interface between the receptacle 15 and the light bulb 21*a* or 21*c***.

Referring back to FIGS. 1–3, the receptacle 15 joins the hollow conduit 16 at the base 18 of the receptacle 15. The hollow conduit 16 provides a conduit for air flow between the receptacle 15 and the vacuum bulb 12. The conduit 16 also provides a stiff member to transmit applied torque from one portion of the device 10 to another. Finally, as the device 10 is to be used to manipulate light bulbs in the area of remote fixtures, the conduit 16 may be formed having any length necessary to bridge the distance between the remote fixture and a user. Preferably, the device 10 is of a sufficient length to provide access to remote household fixtures by an ordinary user (i.e., ceiling fixtures in a household).

The vacuum bulb 12 may be attached to the hollow conduit 16 by means of a hollow cylindrical projection 22 having annular ribs **23*a* to increase the integrity of the bulb/conduit joint 24. Further the projection 22 may be endowed with longitudinal ribs 23*b* to provide rotational integrity to the joints. Functionally, these longitudinal ribs 23*b* allow a user to rotate the vacuum bulb 12, and the device 10 transmits the rotation to an engaged light bulb. In addition, the strength of the joint 24 may be increased by cementing the joint with an adhesive which is compatible with the material of both the plastic structure 11 and the vacuum bulb 12. The vacuum bulb 12** itself is preferably formed of an elastomeric material such as natural or synthetic rubber, etc.

To help to reduce the effort required to remove stubborn light bulbs, those which are tightly held within a socket, a pair of projections 17 extend outwardly from the hollow conduit 16 proximate the bottom end 14 of the plastic structure 11. In the preferred embodiment, the projections 17 are formed substantially in a plane perpendicular to the longitudinal axis A—A and are disposed approximately 180° apart (on opposite sides of the hollow conduit 16).

To allow the use of a polymeric material which provides a flexible annular rim 20, the plastic structure 11 preferably incorporates structural ridges 25 on its outer surfaces. These ridges 25 increase the stiffness and ability of the structure 11 to transmit applied torque to a light bulb 21 which is held in contact with the receptacle 15 or annular rim 20. In addition, the projections 17 may include flange portions 26 to provide structural and dimensional stability. However, the inner surface of the receptacle 15 is preferably essentially free of such ridges to allow for a clean contact surface between the receptacle 15 and a light bulb 21.

Figure 4:
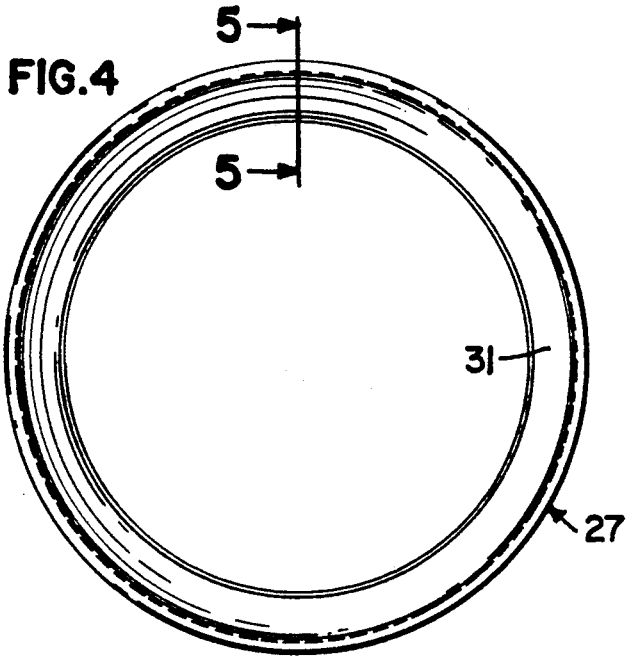
FIG. 4 illustrates a top view of the annular, friction-enhancing collar of the invention.
Figure 5:
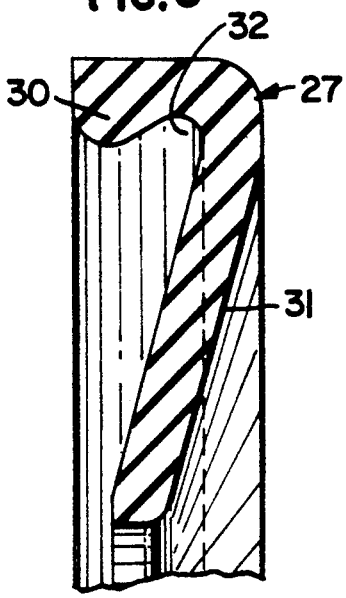
FIG. 5 is a cross-sectional view of the collar along line 5—5 of FIG. 4.

Finally, in order to improve the ability of the device 10 to securely grip a light bulb 21, especially a flatter surface as in a flood light **21*b*, an annular friction-enhancing collar 27 may be removably attached to the annular rim 20 (FIGS. 4 and 5). The collar 27 has an inner lip 30 and outer, friction surface 31. The inner lip 30 is arranged and configured to fit over the outer edge of the annular rim 20, engaging the outer edge of the rim 20 in pocket 32. This provides the friction face 31 in a position to grip a light bulb. Preferably collar 27 and annular rim 20 are sealingly engaged. This collar 27** is preferably formed of a flexible, elastomeric material such as natural or synthetic rubber. However, other elastomers which can provide significant traction to transmit shear motion to a glass surface may be used.

In operation of the device 10 to install a light bulb, a user deforms the vacuum bulb 12 and contacts the surface 28 of a light bulb **21*b* opposite the electrical contacts 29 to sealingly engage the annular rim 20 and the bulb surface 28. The vacuum bulb 12 is then released to evacuate the volume defined by the light bulb surface 28, the annular rim 20 and the receptacle 15. This reduced pressure within the device 10** holds the light bulb 21*b* onto the device 10. In addition, due to the interaction between the receptacle 15 and/or annular rim 20 and the light bulb surface 28, rotational movement about the longitudinal axis A—A of the device 10 is transmitted to the light bulb 21*b*. The bulb 21*b* may thereby be screwed into an electrical fixture (not shown) by applying a rotational movement to the projections 17. Once the light bulb 21*b* has been securely fastened into the electrical fixture, the vacuum bulb 12 may again be deformed to equalize the air pressure between the interior of the device 10 and the atmosphere, and the device 10 may be easily withdrawn from the fixture.

Of course, the reverse of the above-outlined procedure may be used to remove a light bulb 21*b* from an electrical fixture. In this procedure, the projections 17 may be especially helpful to increase the torque applied to a stubborn light bulb 21*b* without requiring a great amount of torque applied to the device.

Other modifications of the invention will be apparent to those skilled in the art in light of the foregoing description. This description is intended to provide specific examples of individual embodiments which clearly disclose the present invention. Accordingly, the invention is not limited to these embodiments or to the use of elements having specific configurations and shapes as presented herein. All alternative modifications and variations of the invention which follow in the spirit and broad scope of the appended claims are included.

What is claimed is:

1. A device having a longitudinal axis connecting a top, receiving end and a bottom end, which device is useful for manipulating light bulbs and comprises:

(a) a unitary thermoplastic polymeric construction comprising:

(i) an essentially frusto-conical receptacle for sealingly engaging a screw-type light bulb located adjacent the receiving end symmetrically disposed about the longitudinal axis having a radius from the longitudinal axis which increases toward the receiving end;

(ii) an annular flexible rim operatively connected to the receiving end of the receptacle having a radius from the longitudinal axis which increases toward the receiving end and a thickness which is less than that of the receptacle;

(iii) an elongate, hollow conduit having longitudinal structural ribs operatively connected to the bottom end of the receptacle for transferring a fluid to and from the receptacle which is arranged and configured to transfer applied torque to the receptacle;

(iv) at least one projection operatively connected to and extending outwardly from the hollow conduit arranged and configured to receive and convey force about the longitudinal axis to the hollow conduit and receptacle to install or remove screw-type light bulbs from an electrical fixture; and (b) means for evacuating and repressurizing the conduit operatively connected to the bottom end thereof.

2. The device of claim 1 wherein a receptacle wall and the longitudinal axis form a first angle of about 25° to 40°.

3. The device of claim 2 wherein the annular rim is essentially frusto-conical.

4. The device of claim 3 wherein the annular rim and the longitudinal axis form a second angle which is greater than the first angle.

5. The device of claim 4 wherein the second angle is at least about 45°.

6. The device of claim 1 wherein the means for evacuating and repressurizing the conduit comprises a vacuum bulb.

7. The device of claim 1 wherein the at least one projection comprises a pair of projections radiating outwardly from the hollow conduit spaced approximately 180° one from the other and substantially in a plane perpendicular to the longitudinal axis.

8. The device of claim 1 which further comprises an annular friction-enhancing collar removably attached to the annular rim.

* * * * *